US006012168A

United States Patent [19]

Hutton et al.

[11] Patent Number: 6,012,168

[45] Date of Patent: Jan. 11, 2000

[54] PRIVACY ACCESSORY FOR USE WITH HOSPITAL GOWNS

[76] Inventors: Laurie A. Hutton; Lois A. Listopad, both of 2437 Horseshoe Canyon, Los Angeles, Calif. 90046

[21] Appl. No.: 09/188,429

[22] Filed: Nov. 9, 1998

[51] Int. Cl.[7] ..... A41D 27/12; A41D 27/26; A41B 9/00; A41C 1/00

[52] U.S. Cl. ..... 2/114; 2/47; 2/267; 2/400; 450/153

[58] Field of Search ..... 2/46, 47, 48, 51, 2/52, 114, 267, 109, 78.1, 78.2, 78.3, 78.4, 400; 450/94, 95, 153; 128/849, 891

[56] References Cited

U.S. PATENT DOCUMENTS 4,459,703 7/1984 Kosmas et al. ..... 2/48
4,689,829 9/1987 Kaplan ..... 2/46
5,557,801 9/1996 Jakus ..... 2/2
5,625,895 5/1997 Sovereign ..... 2/467

*Primary Examiner*—William Stryjewski
*Assistant Examiner*—Shinra L. Jenkins
*Attorney, Agent, or Firm*—Henderson & Sturm

[57] ABSTRACT

A privacy accessory 10 to be worn underneath a conventional hospital gown 100 having a rear opening 101 which normally exposes the buttocks area of a patient. The privacy accessory 10 includes a cover member 20 dimensioned to cover the buttocks area of the patient and a pair of strap members 30 dimensioned to encircle the user's torso beneath the hospital gown 100 and position the cover member 20 over the buttocks area of the patient.

7 Claims, 1 Drawing Sheet

PRIVACY ACCESSORY FOR USE WITH HOSPITAL GOWNS

BACKGROUND OF THE INVENTION

1. Field of the Invention

The present invention relates to the field of modesty garments in general, and in particular to a privacy garment to cover a patient's regions that are normally exposed by a rear opening hospital gown.

2. Description of Related Art

As can be seen by reference to the following U.S. Pat. Nos. 4,459,703; 4,689,829; 5,557,801; and 5,625,895, the prior art is replete with myriad and diverse protective garments for an individual's buttock area to prevent injury.

While all of the aforementioned prior art constructions are more than adequate for the basic purpose and function for which they have been specifically designed, they are uniformly deficient with respect to their failure to provide a simple, efficient, and practical modesty coverage for an individual's buttocks area while wearing a hospital gown.

As most medical patient's are all too acutely aware, all hospital style gowns having rear openings seem designed to maximize the potential for embarrassment due to the virtually unavoidable exposure of the patient's buttock area while wearing such a gown.

As a consequence of the foregoing situation, there has existed a longstanding need among hospital patients for a new and improved type of privacy accessory that can be worn underneath a hospital gown to cover the patient's buttock area, and the provision of such an invention is a stated objective of the present invention.

BRIEF SUMMARY OF THE INVENTION

Briefly stated, the privacy accessory that forms the basis of the present invention comprises in general, a cover unit and a securing unit for selectively positioning the cover unit over the buttocks area of the user.

As will be explained in greater detail further on in the specification, the cover unit comprises a cover member including an enlarged panel of relatively thin fabric which is dimensioned to cover a person's buttock area. The securing unit comprises a pair of elongated relatively thin straps members that are preferably formed integrally with the upper portions of the cover member and are dimensioned to encircle the user's torso to secure the cover unit in place.

In addition, in one version of the preferred embodiment, the lower end of the cover member is scalloped to conform and extend below the cheek portion of each buttock, such that the portion of the cover member that is exposed by the rear opening in the hospital gown resembles a conventional undergarment.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 3:
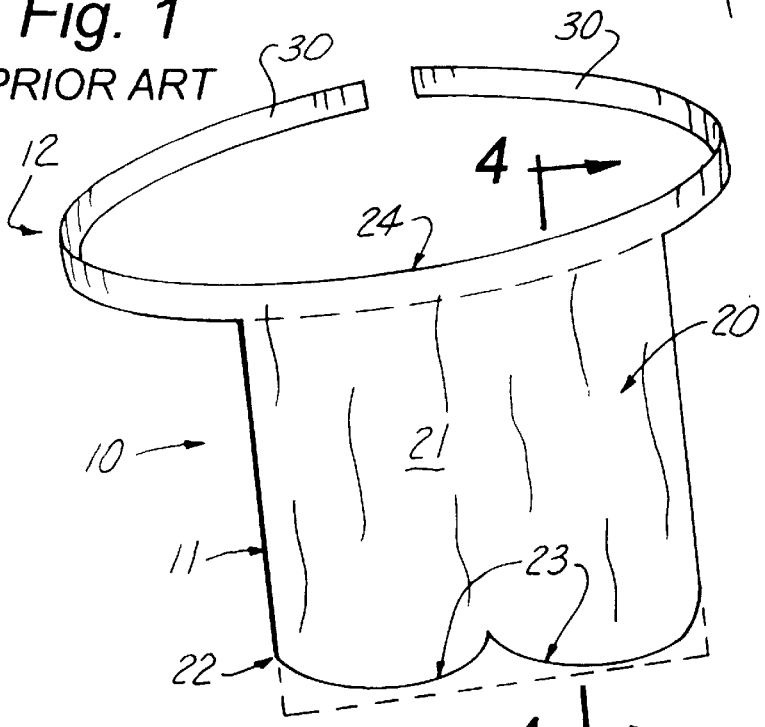
FIG. 3 is a perspective view of the privacy accessory.

As can be seen by reference to the drawings, and in particularly to FIG. 3, the privacy accessory that forms the basis of the present invention is designated generally by the reference number 10. The privacy accessory 10 comprises in general, a cover unit 11 and a securing unit 12. These units will now be described in seriatim fashion.

As shown in FIG. 3, the cover unit 11 comprises a cover member 20 fabricated from an enlarged generally rectangular fabric panel 21 (shown in phantom) wherein the lower end 22 of the fabric panel may be optionally provided with two large scalloped segments 23 (shown in solid lines). Each scalloped segment 23 is dimensioned to cover and extend below the lower cheek portion of each buttock.

Figure 4:
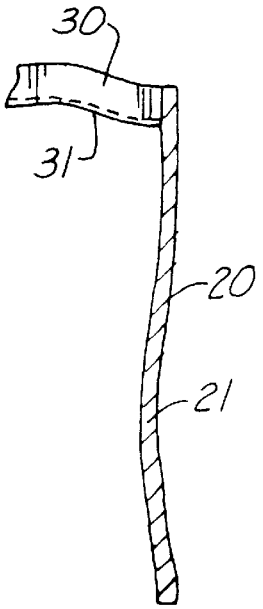
FIG. 4 is a cross sectional view taken through line 4—4 of FIG. 3.

In addition, in the preferred embodiment of the invention depicted in FIGS. 3 and 4, the cover member 20 is fabricated from a single thickness fabric panel consisting of paper or thin cotton for cost factors or ease of cleaning.

Still referring to FIG. 3, it can be seen that the securing unit 12 comprises a pair of elongated strap members 30 extending outwardly from the upper end 24 of the cover member 20.

In the preferred embodiment of the invention, the strap members 30 are formed integrally with the upper end of the cover member 20 and fabricated from the same material as the fabric panel 21.

In addition, this invention also contemplates the fabrication of the strap members 30 as a single thickness or as a double thickness element for strength wherein the two thicknesses are joined together by stitching 31 shown in FIG. 4 or by adhesives (not shown).

Figure 1:
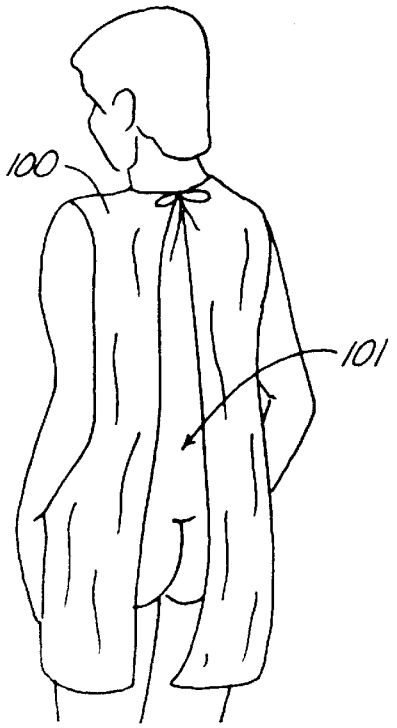
Fig. 1 PRIOR ART
FIG. 1 is a rear view of a patient wearing a hospital gown which expose the buttocks area.
Figure 2:
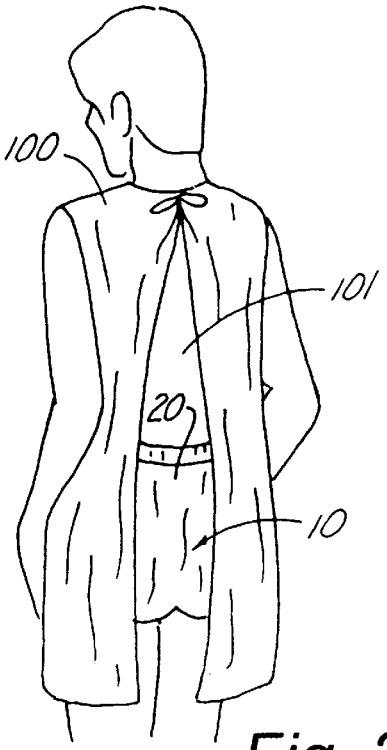
FIG. 2 is a rear view of a patient wearing the privacy accessory beneath a conventional hospital gown.

Turning now to FIGS. 1 and 2, it can be seen that in the prior art arrangement, a conventional hospital gown 100 having a rear opening 101 invariably exposes the patient's buttocks and cleavage. However, by wearing the privacy accessory 10 of the present invention under the hospital gown 100, the cover member 20 covers the formerly exposed buttocks area.

In addition, the privacy accessory 10 does not interfere with virtually any routine medical procedure in that the cover member 20 can be flipped upwardly to expose the patient's buttock area for injections and/or other routine medical procedures.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A privacy accessory for use in combination with conventional hospital gowns having a rear opening that normally exposes the buttock area of a patient wherein the privacy accessory consists of:

a cover unit including an enlarged generally thin cover member dimensioned to only cover the buttocks area of a patient, and having a lower end which is provided with two enlarged scalloped segments which are dimensioned to cover the lower end of the patient's buttocks area; and a securing unit including a pair of strap members operatively associated with the cover member and dimensioned to encircle the torso of the patient to suspend and position the cover member beneath the hospital gown and in a covering relationship with the patient's buttocks area.

2. The privacy accessory as in claim 1 wherein the cover member and the strap members are formed integrally with one another.

3. The privacy accessory as in claim 1 wherein the cover member includes a single thickness fabric panel.

4. The privacy accessory as in claim 1 wherein both the cover member and the pair of strap members are fabricated from paper.

5. The privacy accessory as in claim 1 wherein both the cover member and the pair of strap members are fabricated from cotton.

6. The privacy accessory as in claim 3 wherein the strap members are fabricated from a single thickness.

7. The privacy accessory as in claim 3 wherein the strap members are fabricated from a single thickness which is doubled over to form double thickness strap members.

* * * * *